US005992057A

United States Patent [19]

Monti

[11] Patent Number: 5,992,057

[45] Date of Patent: Nov. 30, 1999

[54] STRAPPING AND CLOSURE SYSTEM FOR AN ARTICLE OF FOOTWEAR

[75] Inventor: Steven A. Monti, Cumberland, R.I.

[73] Assignee: Reebok International Ltd., Stoughton, Mass.

[21] Appl. No.: 09/015,770

[22] Filed: Jan. 29, 1998

[51] Int. Cl.[6] ..... A43B 7/20; A43C 11/00

[52] U.S. Cl. ..... 36/89; 36/50.1; 36/50.5; 36/58.5; 36/72 R

[58] Field of Search ..... 36/89, 92, 117.9, 36/58.5, 58.6, 170, 72 R, 50.1, 50.5

[56] References Cited

U.S. PATENT DOCUMENTS

| | | |
|---|---|---|
| 324,365 | 8/1885 | Cowan . |
| 1,265,280 | 5/1918 | Tweedie . |
| 1,416,421 | 5/1922 | Seibert . |
| 1,606,862 | 11/1926 | Zenishek . |
| 1,845,031 | 2/1932 | Arthur . |
| 1,863,592 | 6/1932 | Dawes . |
| 2,806,300 | 9/1957 | Morgan, Jr. et al. . |
| 3,310,889 | 3/1967 | Samuels . |
| 3,327,410 | 6/1967 | Park, Sr. et al. . |
| 3,456,366 | 7/1969 | Boeing . |
| 3,529,368 | 9/1970 | Canfield . |
| 4,065,861 | 1/1978 | Pelfrey . |
| 4,079,527 | 3/1978 | Antonious . |
| 4,080,745 | 3/1978 | Torrance . |
| 4,120,101 | 10/1978 | Drew . |
| 4,132,016 | 1/1979 | Vaccari . |
| 4,282,657 | 8/1981 | Antonious . |
| 4,308,672 | 1/1982 | Antonious . |
| 4,373,275 | 2/1983 | Lydiard . |
| 4,411,077 | 10/1983 | Slavitt . |
| 4,441,265 | 4/1984 | Burns et al. . |
| 4,476,639 | 10/1984 | Zaccaria . |
| 4,489,719 | 12/1984 | Lapenskie . |
| 4,547,981 | 10/1985 | Thais et al. . |
| 4,562,654 | 1/1986 | Hue . |
| 4,577,419 | 3/1986 | Chassaing . |
| 4,621,648 | 11/1986 | Ivany . |
| 4,640,025 | 2/1987 | DeRenzo . |
| 4,811,500 | 3/1989 | Maccano . |
| 4,845,864 | 7/1989 | Corliss . |
| 4,901,452 | 2/1990 | Wang . |
| 4,922,630 | 5/1990 | Robinson . |
| 4,924,605 | 5/1990 | Spademan . |
| 5,067,486 | 11/1991 | Hely . |
| 5,074,059 | 12/1991 | Melcher . |
| 5,092,319 | 3/1992 | Grim . |
| 5,154,011 | 10/1992 | Holzl et al. . |
| 5,243,772 | 9/1993 | Francis et al. . |
| 5,319,869 | 6/1994 | McDonald et al. . |
| 5,377,430 | 1/1995 | Hatfield et al. . |
| 5,771,608 | 6/1998 | Peterson . |
| 5,819,439 | 10/1998 | Sanchez . |

FOREIGN PATENT DOCUMENTS

| | | |
|---|---|---|
| 2 541 566 | 8/1984 | France . |

*Primary Examiner*—Ted Kavanaugh
*Attorney, Agent, or Firm*—Sterne, Kessler, Goldstein & Fox P.L.L.C.

[57] ABSTRACT

An article of footwear including a strapping and closure system providing additional support to a wearer's ankles and feet. The system includes a pair of heel straps fixedly attached to opposing sides of the article of footwear and includes an instep piece that is also fixedly attached to the article of footwear. The heel straps and the instep piece are not fixedly attached to an upper of the article of footwear, but are fixedly attached to a lasting board of the article of footwear, thereby allowing the heel straps and the instep piece to be tightened independently of an upper of the article of footwear. The article of footwear further includes a breathable piece of material or shroud attached to a base of the upper for protecting the upper from mud and dirt.

12 Claims, 5 Drawing Sheets

STRAPPING AND CLOSURE SYSTEM FOR AN ARTICLE OF FOOTWEAR

BACKGROUND OF THE INVENTION

1. Field of the Invention

The present invention relates to a strapping and closure system for an article of footwear. In particular, the present invention relates to a heel and instep strap and closure system for an athletic shoe. The present invention further includes a spat fit system for the athletic shoe.

2. Related Art

In many sports, athletes tape their ankles and feet to provide added support during play. For example, in soccer and football, athletes are prone to having ankle injuries due to the quick lateral movements required to play these sports. Further, in some sports requiring substantial contact between players, such as football, players also tape their shoes to their feet, to prevent the shoes from coming off during play. This taping over the top of the shoe also provides added support to the wearer's ankles and feet.

Athletes and trainers have devised a taping system to provide added support to their ankles and feet. What is needed is a strapping and closure system for a shoe that is similar to the taping system commonly utilized by athletes.

SUMMARY OF THE INVENTION

The article of footwear of the present invention overcomes the problems of the prior art by providing a strapping and closure system that provides additional support to a wearer's ankles and feet. The system includes a pair of heel straps and an instep piece that are fixedly attached to the article of footwear. The heel straps and the instep piece are not fixedly attached to an upper of the article of footwear and may be tightened independently of the upper. The article of footwear further includes a breathable shroud attached to a base of the upper for protecting the upper from mud and dirt.

It is a object of the present invention to provide an article of footwear having a strapping and closure system to provide additional support to a wearer's ankles and feet.

It is a further object of the present invention to provide a strapping and closure system that is fixedly attached to a lasting board of a shoe but remains unattached to an upper of the shoe whereby the strapping and closure system may be tightened independently of the upper of the shoe.

It is a still further object of the present invention to provide a piece of material or shroud attached to a base of the upper of the shoe for protecting the upper of the shoe from mud and dirt while allowing the shoe to breath.

BRIEF DESCRIPTION OF THE FIGURES

The foregoing and other features and advantages of the invention will be apparent from the following, more particular description of a preferred embodiment of the invention, as illustrated in the accompanying drawings.

DETAILED DESCRIPTION OF THE PREFERRED EMBODIMENTS

A preferred embodiment of the present invention is now described with reference to the figures where like reference numbers indicate identical or functionally similar elements. Further, although only one shoe in a pair of shoes is shown in the figures, the left and right shoes are mirror images of each other. While specific configurations and arrangements are discussed, it should be understood that this is done for illustrative purposes only. A person skilled in the relevant art will recognize that other configurations and arrangements can be used.

The present invention is intended to be used for all types of athletic shoes, including, for example, sandals, hiking boots, basketball shoes, football shoes, soccer shoes, cross-training shoes, tennis shoes, cycling shoes, wrestling shoes, ice skates, in-line skates, ski boots, etc. Further, the present invention is described herein as applied to an athletic shoe, however, it would be apparent to one skilled in the relevant art, that the strapping and closure system of the present invention could also be used in casual shoes and work boots. Still further, one skilled in the relevant art would also recognize the strapping and closure system of the present invention could also be used in orthopedic devices and other foot and ankle supports.

Figure 1:
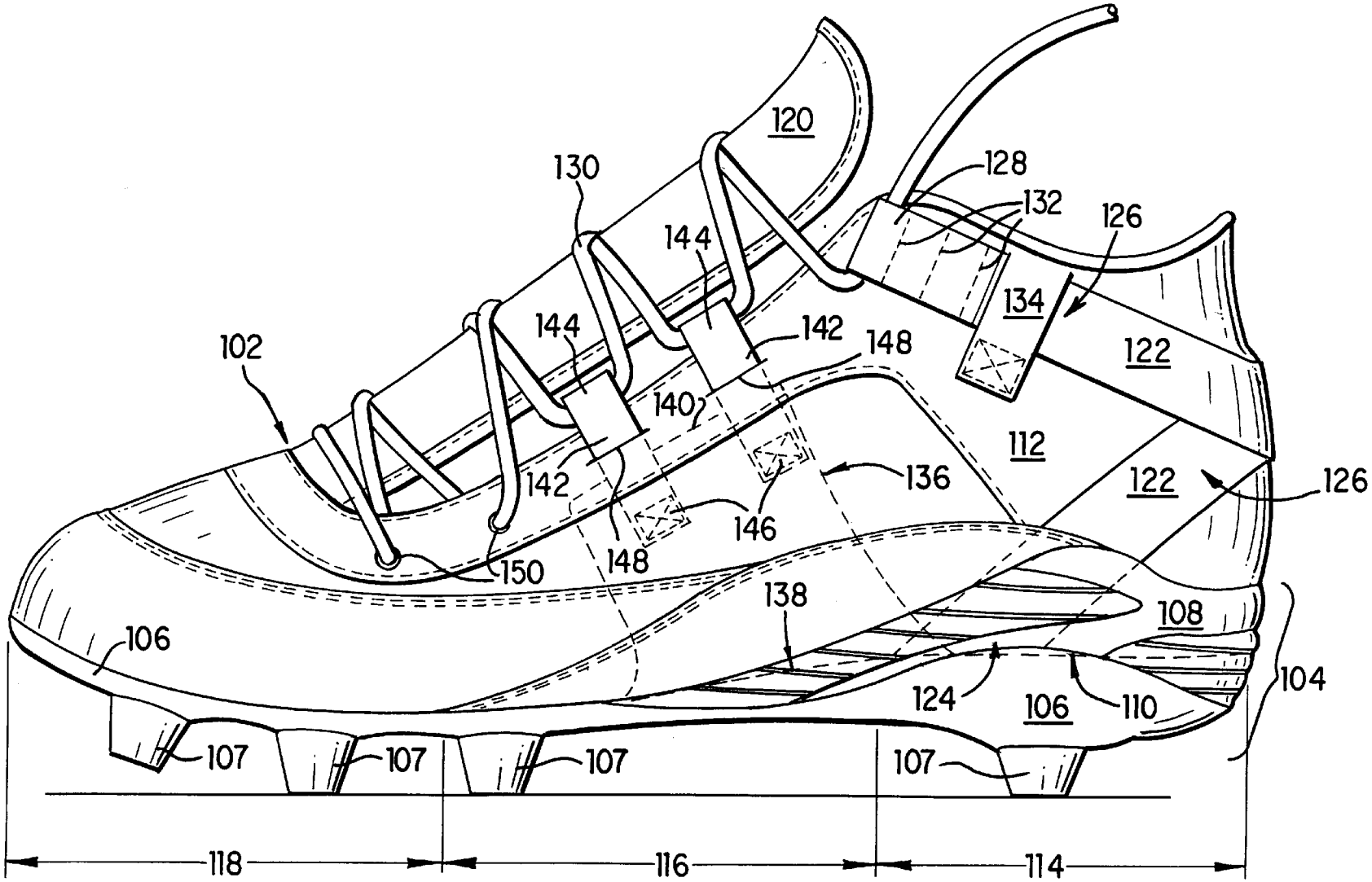
FIG. 1 shows a side, plan view of an athletic shoe having a strapping and closure system of the present invention.
Figure 2:
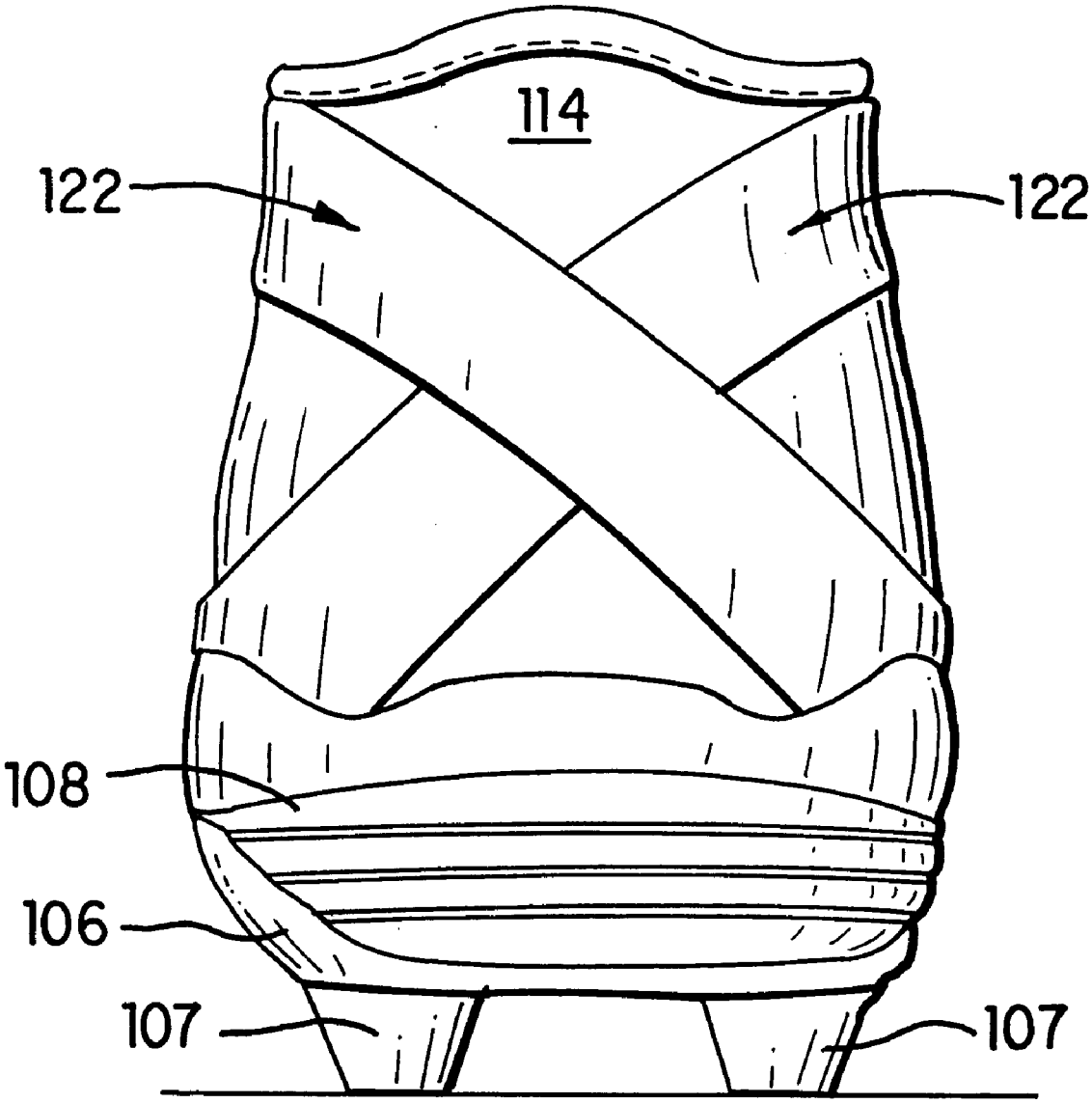
FIG. 2 shows a rear, plan view of the athletic shoe of FIG. 1.
Figure 3:
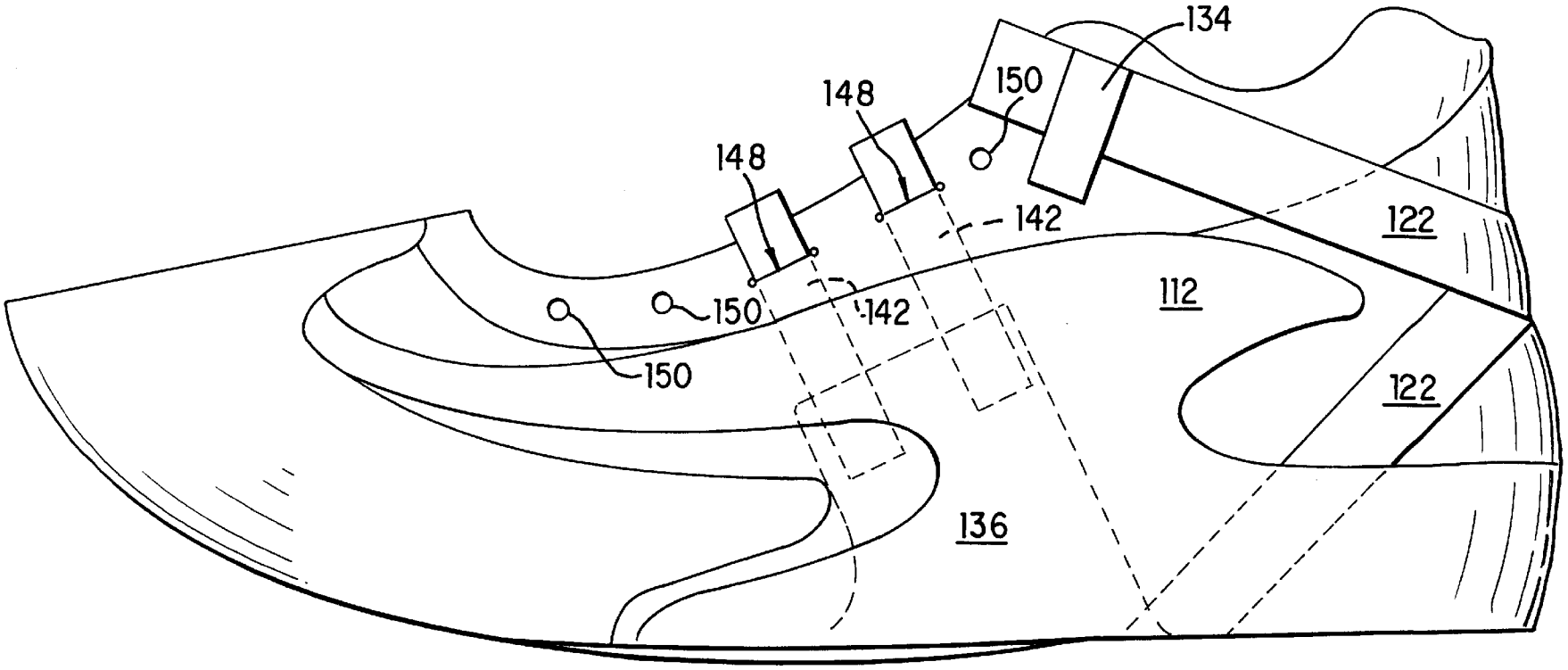
FIG. 3 shows a shell pattern of an upper of the athletic shoe of FIG. 1.

A first embodiment of an article of footwear having a strapping and closure system according to the present invention is shown in FIGS. 1–3. FIG. 1 shows an athletic shoe 102, including a sole 104, comprised of an outsole 106 and a midsole 108. In the exemplary shoe 102 shown in FIG. 1, outsole 106 includes cleats 107. However, a cleated shoe is shown by way of example only, as the strapping and closure system of the present invention is equally applicable for use with non-cleated shoes.

Shoe 102 further includes a lasting board 110 (shown as a dashed line) and an upper 112. Upper 112 extends upwardly from and is fixedly attached to sole 104. Upper 112 includes a heel area 114, a midfoot area 116, a toe area 118 and a tongue 120. As shown in FIG. 1, tongue 120 is stitched at its base portion to upper 112.

The present invention includes a pair of heel straps 122. As shown in FIG. 1, each heel strap 122 has a first end 124 fixedly attached to lasting board 110 on the medial and lateral sides of shoe 102. Heel strap 122 has an unattached second end 126, which extends from lasting board 110, upwardly and rearwardly between midsole 108 and upper 112 toward the rear of heel area 114. Second ends 126 cross over one another (as shown in FIG. 2) at the rear of heel area 114 and then extend forwardly and upwardly from heel area 114 toward the front edge of upper 112, adjacent tongue 120.

In one embodiment, the tips of second ends 126 have a loop 128 through which a lace 130 can be received. In one embodiment, loop 128 is formed by doubling over the material used to form heel straps 122 and adding stitching 132 across the material. However, it would be apparent to one skilled in the relevant art, that other means of forming a loop could be used, such as adding D-rings, metal or plastic loops, or similar hardware to second ends 126.

In the embodiment shown in FIG. 1, second ends 126 are slid under a slit 134 formed on each side of upper 112. Second ends 126 are not attached to upper 112 so that they may be tightened independently about upper 112. It would be apparent to one skilled in the relevant art that other designs could be fashioned to hold second ends 126 in place adjacent upper 112 without stitching heel straps 122 to upper 112.

Shoe 102 further includes instep pieces 136 having first ends 138 and second ends 140. First ends 138 of instep pieces 136 are fixedly attached to lasting board 110 on the medial and lateral sides thereof Second ends 140 of instep pieces 136 are unattached and extend upwardly along the inner medial and lateral sides of midfoot area 116 of upper 112. In an alternate embodiment, a single piece of material could be used to form instep piece 136, which would extend under, and be fixedly attached to, lasting board 110 and extend upwardly along the inner medial and lateral sides of midfoot area 116 of upper 112.

In a further alternate embodiment, a single piece of material could be used to form an integral heel strap/instep piece.

Instep pieces 136 each have instep straps 142 fixedly attached to second ends 140. Instep straps 142 each have a loop 144 at one end for receiving lace 130 therethrough. In one embodiment, loop 144 is formed by doubling over the material used to form instep straps 142 and adding stitching 146 across the material at the point at which instep straps 142 are attached to second ends 140 of instep pieces 136. However, it would be apparent to one skilled in the relevant art, that other means of forming a loop could be used, such as adding D-rings, metal or plastic loops, or similar hardware to instep straps 142.

As shown in FIG. 1, instep straps 142 are disposed through slits 148 formed in midfoot area 116 of upper 112. Instep straps 142 are unattached to upper 112 so that they may be tightened independently of upper 112. Midfoot area 116 of upper 112 also may include eyelets 150 or other conventional lacing devices. Although only two instep straps 142 are shown in FIG. 1, it would be apparent to use one or more of such straps depending on the amount of support desired about the instep region.

Figure 4:
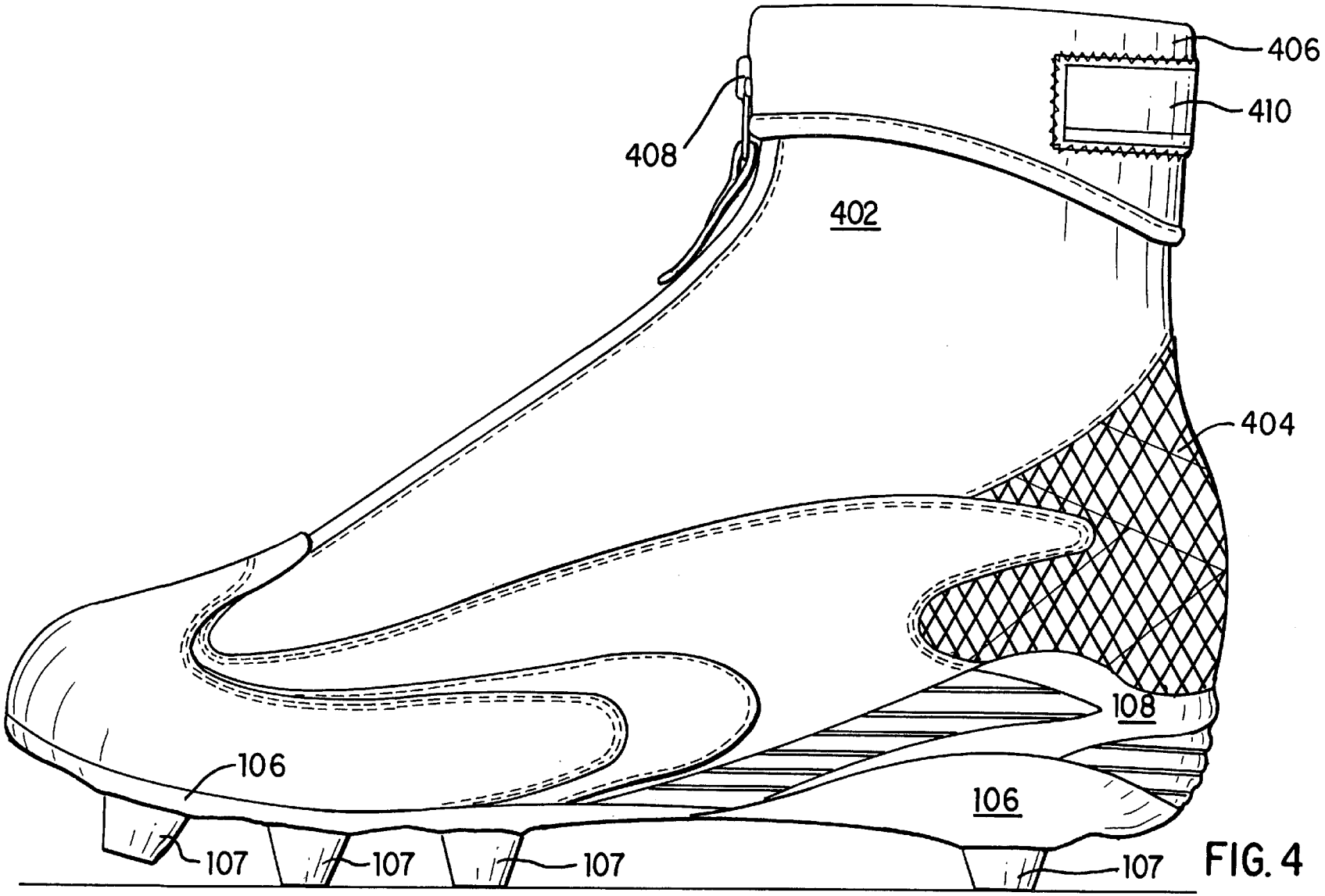
FIG. 4 shows an alternate embodiment of an athletic shoe having a strapping and closure system and shroud of the present invention.
Figure 6:
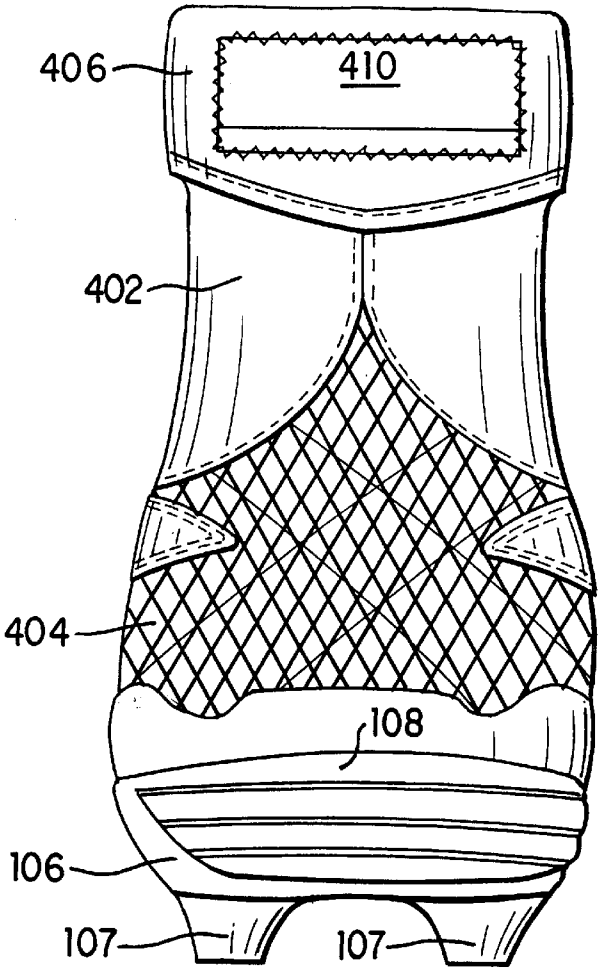
FIG. 6 shows a rear, plan view of the athletic shoe of FIG. 4.
Figure 5:
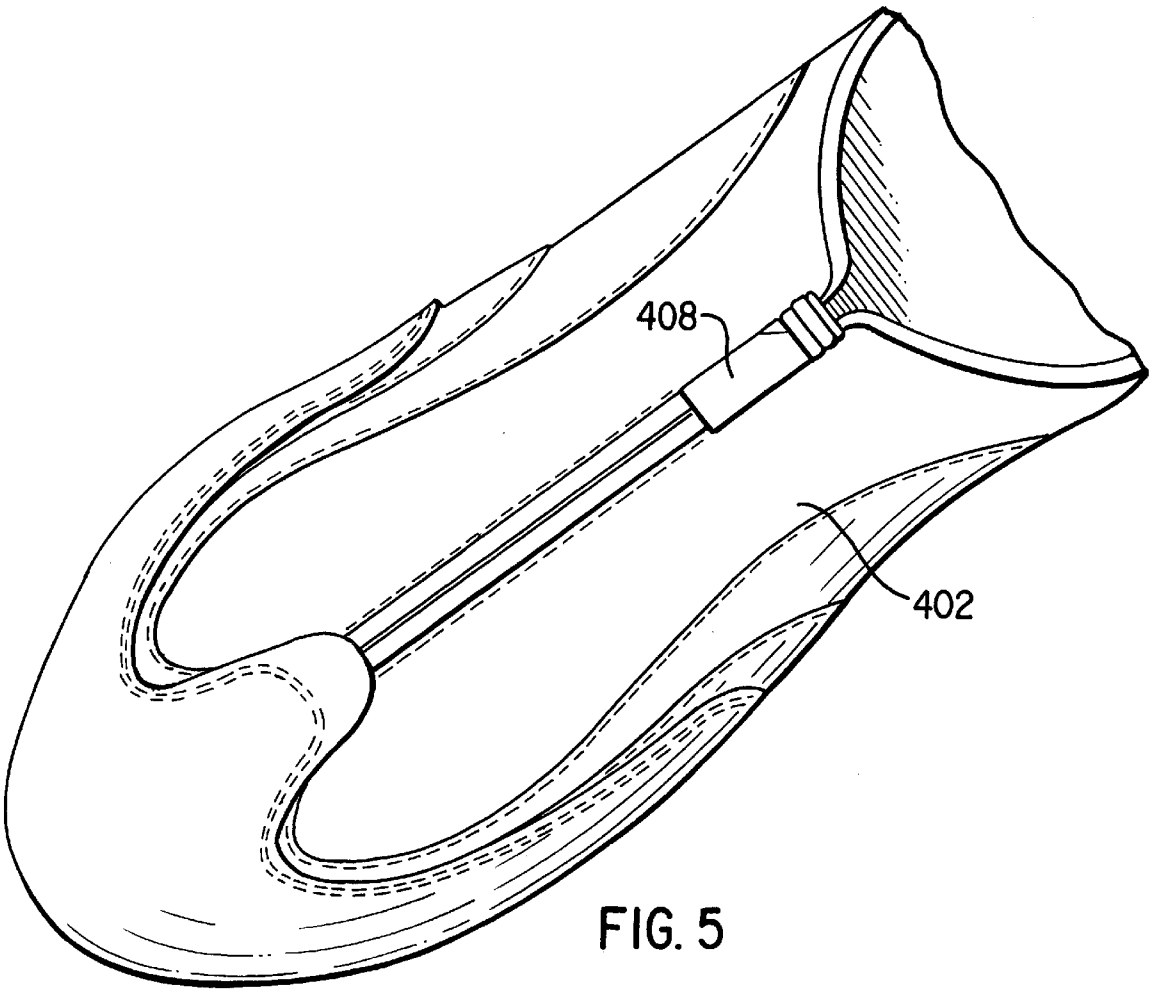
FIG. 5 shows a partial top, plan view of the athletic shoe of FIG. 4.

A second embodiment of the present invention is shown in FIGS. 4–6. In this embodiment, shoe 102 includes a piece of material or shroud 402 which is attached to the base of upper 112, and extends upwardly about the exterior of upper 112 to about the top portion of upper 112. Shroud 402 protects upper 112 from direct contact with dirt and water. Shroud 402 also prevents heel straps 122, instep pieces 136, instep straps 142, lace 130, and other portions of the shoe from catching during use. For example, shroud 402 may prevent injury of a user by preventing lace 130 and other portions of shoe 102 from catching on equipment during use, such as catching in a chain while riding a bicycle. In one embodiment, shroud 402 is made of spandex. In an alternate embodiment, shroud 402 is made of neoprene. It would be apparent to one skilled in the relevant art the shroud 402 can be made from a variety of stretchable, and preferably breathable, materials.

Shroud 402 is generally constructed so that it obscures upper 112 and the strapping and closure system shown in FIG. 1. In one embodiment, shroud 402 includes a mesh portion 404 made from a nylon mesh material. Although only one mesh portion 404 is shown over heel area 114 of upper 112, other mesh portions 404 could be integrated into shroud 402 to provide several see-through areas. Shroud 402 can be constructed from a single piece of material or from several pieces of material that have been stitched together or overlaid, as shown in FIG. 4.

Shroud 402 further includes an upper portion 406, which can be turned down to form a cuff as shown in FIGS. 4 and 6. A logo or tag 410 can be stitched onto the inside of upper portion 406 so that when it is turned down, tag 410 is visible. Tag 410 is shown stitched to the rear of shroud 402. However, tag 410 could also be stitched anywhere on the inside of upper portion 406 or anywhere on the outside of shroud 402.

Shroud 402 includes a zipper 408. As shown in FIG. 4, zipper 408 is disposed upwardly along the front of shroud 402, over tongue 120. However, in an alternate embodiment, zipper 408 can be disposed along the back of shroud 402, over heel area 114 of upper 112. It would be apparent to one skilled in the relevant art, that zipper 408 could be placed in a variety of locations, including, for example, along the medial or lateral sides of shroud 402. It would also be apparent to one skilled in the relevant art, that various closure systems could be used, including, for example, buttons, snaps, and VELCRO.

While the invention has been particularly shown and described with reference to preferred embodiments thereof, it will be understood by those skilled in the art that various changes in form and details may be made therein without departing from the spirit and scope of the invention.

What is claimed is:

1. An article of footwear, comprising:

a sole;

an upper extending from said sole, said upper including a heel area, a midfoot area and an instep region;

a pair of heel straps, each heel strap having a first end fixedly attached on opposing sides of the article of footwear and a second end configured to cross over said heel area of said upper and extend upwardly and forwardly toward said midfoot area, wherein said second ends are configured to receive laces therethrough;

an instep piece fixedly attached to the article of footwear and extending upwardly on inner medial and lateral sides of said upper;

a plurality of instep straps, each having a first end fixedly attached to said instep piece and a second end configured to receive laces therethrough; and a shroud fixedly attached to the base of said upper and extending upwardly about said heel area, said midfoot area, and said instep region above a top portion of said upper.

2. The article of footwear of claim 1, further comprising:

a lasting board disposed above said sole, wherein said first end of each of said heel straps and a portion of said instep piece are fixedly attached to said lasting board.

3. The article of footwear of claim 1, wherein said second end of each of said heel straps has a looped end formed for receiving laces therethrough.

4. The article of footwear of claim 1, wherein said second end of each of said heel straps is disposed underneath a slit formed on the medial and lateral sides of said upper.

5. The article of footwear of claim 1, wherein said upper has a plurality of slits formed in said midfoot area, and said second end of said plurality of instep straps is looped through a respective one of said slits formed in said midfoot area of said upper.

6. The article of footwear of claim 1, wherein said pair of heel straps is unattached to said upper.

7. The article of footwear of claim 1, wherein said instep piece and said plurality of instep straps are unattached to said upper.

8. The article of footwear of claim 1, wherein said shroud is made of spandex.

9. The article of footwear of claim 1, wherein said shroud is made of neoprene.

10. An article of footwear, comprising:

a sole;

an upper extending from said sole, said upper including a heel area, a midfoot area and an instep region;

a lasting board disposed above said sole;

a pair of heel straps each having a first end fixedly attached to said lasting board on opposing sides of the article of footwear and a second end having a loop for receiving laces therethrough, said second ends of said pair of heel straps crossing over said heel area of said upper and extending upwardly and forwardly toward said midfoot area, wherein said second ends are disposed underneath a slit formed on either side of said upper;

an instep piece fixedly attached to said lasting board and extending upwardly on inner medial and lateral sides of said upper;

a plurality of instep straps, each having a first end fixedly attached to said instep piece and a second end being looped through holes formed in said midfoot area of said upper and configured to receive laces therethrough; and a shroud fixedly attached to the base of said upper and extending upwardly about said heel area, said midfoot area, and said instep region above a top portion of said upper.

11. The article of footwear of claim 10, wherein said shroud is made of spandex.

12. The article of footwear of claim 10, wherein said shroud is made of neoprene.

* * * * *